United States Patent [19]

Kurz

[11] Patent Number: 4,535,209

[45] Date of Patent: Aug. 13, 1985

[54] PRESSURE-SENSITIVE ELECTRICAL SWITCH

[76] Inventor: Gerhard Kurz, Industriestrasse, 7262 Althengstett, Fed. Rep. of Germany

[21] Appl. No.: 562,209

[22] Filed: Dec. 16, 1983

[30] Foreign Application Priority Data

Nov. 9, 1983 [DE] Fed. Rep. of Germany ..... 3340436

[51] Int. Cl.[3] ..... H01H 35/34

[52] U.S. Cl. ..... 200/83 R; 200/83 N; 200/292; 361/400

[58] Field of Search ..... 339/128, 125, 255 R, 339/108 TP; 200/83 S, 83 SA, 83 R, 83 P, 292, 83 N; 361/400, 405

[56] References Cited

U.S. PATENT DOCUMENTS

| | | | |
|---|---|---|---|
| 3,093,716 | 6/1963 | Horowitz | 200/83 P |
| 3,885,848 | 5/1975 | Broneus | 339/17 C |
| 3,917,917 | 11/1975 | Murata | 200/83 N |

*Primary Examiner*—A. D. Pellinen
*Assistant Examiner*—Morris Ginsburg
*Attorney, Agent, or Firm*—McAulay, Fields, Fisher, Goldstein & Nissen

[57] ABSTRACT

A pressure-sensitive electrical switch is provided with a diaphragm which can be displaced against the action of a spring and which defines together with a supporting housing a pressure chamber. There is at least one outwardly projecting connection contact in the form of a contact pin. For mechanically mounting the housing of the switch there is provided at least one latching element comprising a latch for engagement in a receiving opening of a supporting board or print board or the like, the electric contact with the conductor paths of the printed circuit board being established by an electrically conductive pressure spring superimposed upon the pin-like outwardly projecting connection contact which spring in the latched position of the at least one latching element is urged into contact with the associated electric conductor path. Accordingly, mounting of such a pressure-sensitive switch on the supporting board or print board can be effected without shocks and without the application of important forces so that the prior adjustment of the system is rendered possible.

10 Claims, 2 Drawing Figures

PRESSURE-SENSITIVE ELECTRICAL SWITCH

STATE OF THE ART

Figure 1:
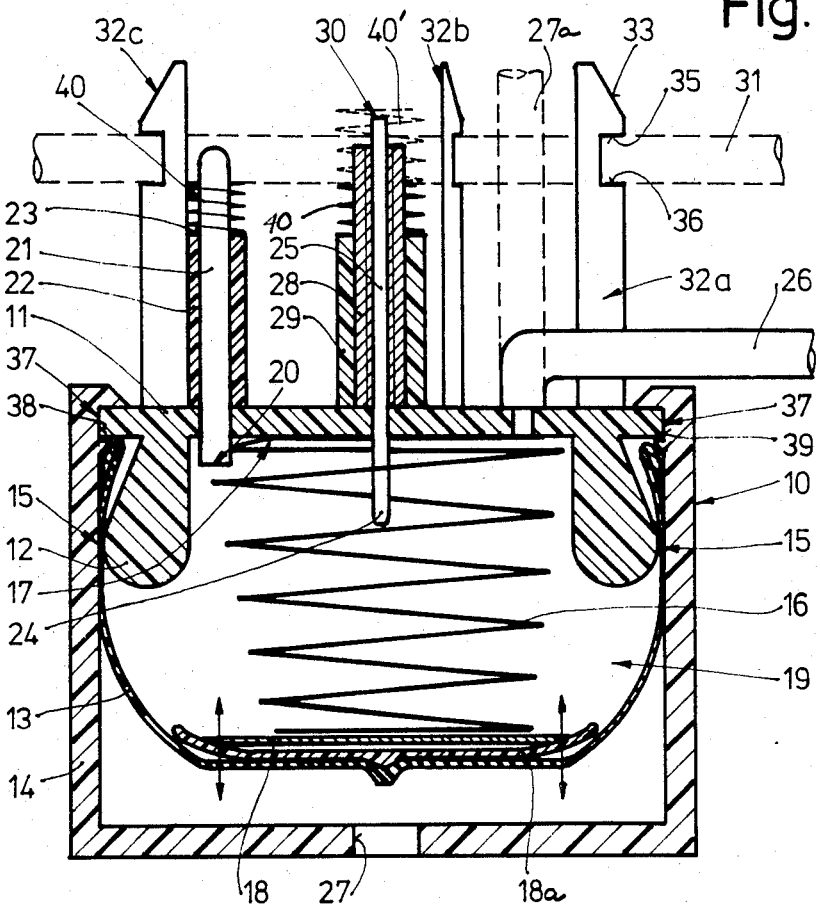

The present invention relates to a pressure-sensitive electrical switch. Diaphragm-driven pressure-sensitive switches which perform a displacement—normally against the action of a biassing spring—when subjected to the action of pressures exceeding or dropping below pre-determined limits so as to generate a corresponding output signal by establishing an electric contact when certain pre-determined pressure values are reached, have been known in the art. Similarly it has been known in the art to fasten such pressure-sensitive switches on supporting boards which may at the same time perform the function of print boards or printed circuits so that the signal is emitted as closely as possible to the circuit elements provided for processing the signal thus obtained to generate corresponding control commands. The switch may be mounted by screwing or else by introducing outwardly projecting contact connections for the electric circuit components into corresponding openings provided for instance in the printed circuit or the print board to permit direct soldering to the existing conductor paths so that both the electric and mechanical connections are simultaneously effected. However in cases where it is not desirable to connect the contacts by soldering, for instance because thermal effects may become critical or for reasons connected with the assembly, then the mechanical connection with the circuit board and the electric connection with the conductor paths provided thereon may also be effected by crimping, caulking, or the like. In this case, the contact pins projecting from the housing of the pressure-sensitive switch are preferably provided with contact collars arranged at a lower level and with a bore on their one end for receiving the caulking tool so that when the required pressure is applied to the latter, an outwardly curved annular lock seam and, thus, a positive connection is formed.

This connection by soldering or caulking certainly leads to a certain simplification, in particular as regards the assembly work, and secures the housing firmly in position. However, problems may be encountered in cases where, as in the present case, the pressure-sensitive switches are of a very sensitive type which requires an extremely fine adjustment and responds to pressure differences as low as 2 mm WG as threshold values. In cases where the pressure-sensitive switch is mounted on the circuit board by the manufacturer, it may be initially fastened by soldering or, preferably, crimping of marginal areas of the electric contact pins, whereafter the necessary adjustment can be effected, using if necessary the same contact pins.

To this end certain embodiments may be provided with contact set screws arranged within contact bushings for displacement by means of a fine thread, as will be described further below. However, such an adjustment effected prior to the assembly would be destroyed by the assembly so that the proper function of any device depending on the correct operation of such a pressure-sensitive switch would be set at risk.

On the other hand there are, however, reasons that make it preferable to have the adjustment to the predetermined pressure values carried out by the manufacturer and to relieve the users from the need to make such sensitive adjustments themselves.

Accordingly, it is the object of the present invention to improve a pressure-sensitive switch so that it can be fully adjusted prior to being mounted in the respective circuit board and that the subsequent mounting process which includes mechanically fastening in place the circuit components constituting the switch and establishing the electric contacts, does not lead to any alteration of the adjustment.

ADVANTAGES OF THE INVENTION

The pressure-sensitive switch of the invention achieves this objective and offers the advantage of being easily, simply and safely connectable to and fixable in place on supporting boards of any type while permitting the electric contacts to be made simultaneously.

This advantage includes the additional decisive advantage that mounting and fastening of the pressure-sensitive switch on the supporting board can be effected at any time and does not result in any alteration of the adjusted values, although when mounting the switch it is of course necessary to establish an operative connection between the outwardly projecting electric connection contacts—which on the other hand have been set during the adjustment and must, therefore, be protected against contacts and shocks—and the conductor paths of the circuit board for the purpose of making the required electric contacts. This latter connection must be safe and resistant to corrosion and aging and, as mentioned before, must not alter the setting of the electric connection contacts.

The invention succeeds in meeting these conflicting requirements by dividing the tasks insofar as the electric connection with the conductor paths (usually printed or laminated upon the print board or printed circuit board) performs no support functions or only accessory supporting functions. On the other hand, the mechanical connection is realized by a locating device comprising at least one latching element arranged on the housing of the switch which coacts with a corresponding opening in the supporting board. Locating devices in which certain parts are connected with others by latching projections have of course been known as such. The decisive aspect in the present invention is, however, to be seen in the fact that this mechanical locking device ensures at the same time a pre-determined spacing between the pressure-sensitive switch and the board, print board or the like, on which it is mounted so that an electrically operative connection can be achieved between contact springs connected to the electric connection contacts projecting from the housing of the pressure-sensitive switch on the one hand, and the conductor paths of the supporting board on the other hand. These contact springs take preferably the form of conventional spiral pressure springs which may, if necessary, be of a stronger type but which after locking the switch in place exert in any case on the supporting board and the conductor paths existing in the respective area a pressure sufficient to ensure the safe and trouble-free electric contact while, on the other hand, the housing of the pressure-sensitive switch can, if desired, be entirely held under a pretension acting in a direction away from the supporting board to ensure that the latching projections will remain in engagement with the latching elements of the housing of the pressure-sensitive switch.

Alternatively, the latching means may be provided with catch stops which once the locating device of the housing of the pressure-sensitive switch has been locked in position, retain the housing in its position in the supporting board even without the biassing effect of the springs.

Other features permit advantageous improvements and developments of the pressure-sensitive switch. A particularly advantageous feature is seen in the protective enclosure of the substantially slack diaphragm, which is exposed to the effects of the atmosphere or the vacuum, by a rigid, cup-shaped cover completing the housing of the pressure-sensitive switch which cover may be subjected also to certain manipulations and pressure serving to fix the switch in place without running the risk of altering the adjustment of the threshold values of the switch.

DRAWING

Figure 2:
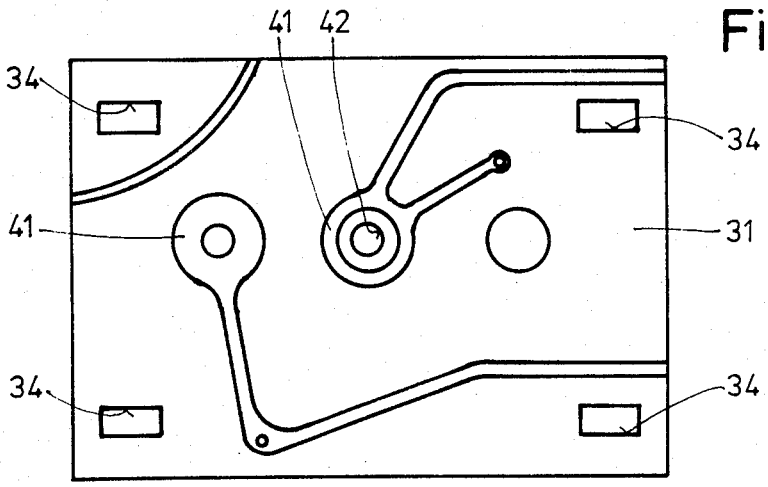

An example of the subject-matter of the invention will be described hereafter in detail in connection with the drawing in which FIG. 1 shows a cross-section of one example of an electrical diaphragm-operated pressure-sensitive switch; and FIG. 2 is a bottom view of the supporting board or printed circuit board in which the housing of the switch is mounted by insertion of its latching elements, with the pressure-sensitive switch removed.

SPECIFICATION

It is the underlying idea of the present invention to simplify the mounting of a switch which reacts sensitively to overpressure or underpressure, on a suitable supporting board without the need for caulking, crimping or soldering work and-by way of further improvement-to provide the possibility to carry out such mounting work substantially without vibration or shocks so that the mounting process does not in any way effect a previously effected fine adjustment of the switch, and this even in cases where the electric contacts between the electric circuit components completing the pressure-sensitive switch and the conductor paths of the supporting board are established simultaneously with the mechanical mounting process, it being of particular importance in this connection that these electric contact means are those parts that have been previously adjusted.

In FIG. 1, a base plate 11 can be seen which supports all other components of the electrical pressure-sensitive switch 10 and which insofar forms part of a housing. The base plate 11 may be injection moulded and comprises an annular flange 12 extending along its periphery and projecting downardly in the drawing. The annular flange 12 serves for being embraced in sealing relationship by the lower portion of a substantially cup-shaped soft rubber-like diaphragm 13. The sealing effect in the contact area between the lower edge of the diaphragm 13 and the annular flange 12 is improved by a substantially cup-shaped cover 14 connected with the base plate 11 preferably by a snapping action but in any case so that it exerts a supplementary sealing pressure in the areas 15 where the annular flange 12 urges the adjacent portions of the diaphragm outwardly, so that the diaphragm is safely held in its position on the annular flange 12 while being at the same time sealed off in these areas.

The diaphragm 13 is elastic and flexible and exhibits as such only minor restoring forces so that it may also be described as a slack diaphragm. It is retained in the position shown in the drawing by a pressure spring 16 bearing at 17 against the inner face of the base plate 11 and extending downwardly—as viewed in the drawing—in the form of a partially tapering sprial until it comes to bear resiliently against the inner face of the diaphragm. The pressure spring 16 is not directly in contact with the diaphragm but has its lower end—as viewed in the drawing—bearing against an electric contact disk 18 overlapped, mainly for insulation purposes, by an intermediate disk **18*a* which for this purpose consists preferably of a suitable plastic material and which in turn rests directly against the inner face of the diaphragm. The diaphragm forms in this manner together with the inner face of the base plate 11 a pressure chamber 19, and the electric contact is made in response to the existing pressure values in that when the pressure spring 16 makes contact with the inner face it simultaneously makes conductive contact at 20 with an inwardly projecting end portion of a contact pin 21. The contact pin 21 projects outwardly through a plastic flange 22 projecting upwardly—in the view of the drawing—from the base plate 11 and ending in a shoulder at 23. The outwardly projecting contact pin 21** forms a first electric connection contact for the electric diaphragm switch constituted by the pressure-responsive switch of the invention.

This is rendered possible by the fact that the pressure spring 16 establishes the electric connection between the contact pin 21 and the base plate 11 and that when the diaphragm is correspondingly compressed, the contact disk 18 finally comes into conductive contact with an end portion 24 of a second electric contact pin 25—thus establishing the electric contact—which second contact pin 25 projects in the drawing substantially centrally through the base plate 11 and can be—adjustably—positioned at a pre-determined distance relative to the contact plate 18.

Now, when low pressure is admitted to the pressure chamber 19 through a bent-off pressure connection 26 or a straight pressure connection **27*a*, or when overpressure is admitted to the pressure-sensitive switch through a pressure inlet/outlet opening 27 in the cover 14, the diaphragm is moved against the action of the biassing spring 16 so that the contact disk 18 approaches the end portion 24 of the second contact pin 25**. The desired threshold pressure values can be pre-set with extreme precision, i.e. tolerances as low as 2 mm WG, so that the pressure-sensitive switch of the invention has a large field of application in particular where electric control commands essential to the function of a device must be obtained already when relatively minor pressure differences are encountered. Some examples of such applications are, for instance, dust bag level indicators in vacuum cleaners, automatic speed-changing controls in vacuum cleaners which must react to pressure drops that may be detected at suitable points, further the "change filter" indication of extractor hoods above cookers, for example, where extremely low pressure differences are involved, and similar applications.

To permit the before-mentioned adjustment of the spacing between the contact disk 18 and the second contact pin 25, the latter is preferably provided with a fine thread by means of which it can be screwed more or less deeply into a metallic contact bushing 28 provided with a matching internal thread. In this manner it is possible to adjust the distance between the contact disk 18 and the forward end 24 of the contact pin 25 projecting through a tapering opening in the base plate 11 into the pressure chamber 19. The threaded contact bushing 28 is in turn held in a plastic flange or cylinder 29 which is preferably integrally formed with the base plate 11. The adjustment can be effected by applying a screw driver to a cross-cut provided at 30 in the end portion of the second contact pin 25 which has the general form of a grub screw.

It appears from what has been said above that once a pressure-sensitive switch of the design described above has been adjusted it is no longer possible to mount it in the printed circuit board 31 shown in FIG. 1 in broken lines by calking, soldering or crimping for instance the contact bushing 28 and/or the contact pin 25, without permanently altering the adjustment.

The invention therefore uses another approach by providing the base plate with at least one latching element, but preferably a plurality of latching elements 32*a*, 32*b* and 32*c* formed as integral parts of the base plate 11 and extending from the latter towards the supporting board or print board 31, for being introduced, if necessary by deflection of the sliding faces 33 of their latches-into matching receiving openings 34 arranged in the supporting or print board 31 shown once more in FIG. 2. When the latches 35 are provided with additional lower stop faces 36 which permits a supporting plate of known thickness to be received between the two stops, then there is no need for additional supporting functions to be performed by biassing springs on the electric connection contacts, as will be described hereafter. In any case, the at least one latching element 32*a* permits the housing of the pressure-sensitive switch to be mounted on the supporting board 31 safely and, besides, absolutely without any shocks or interference with the electric adjustment it being only necessary to hold the switch by its cover 14, to bring the latching elements into alignment with the openings 34 in the supporting board 31, and to exert a short pressure to bring the latching means into engagement whereafter the pressure-sensitive switch will be safely and firmly held in position on the supporting board.

According to an advantageous improvement of the present invention, as regards the mechanical mounting of the pressure-sensitive switch, the cover portion 14 is of a relatively sturdy design and, as can be seen at 37, the peripheral connection of its lower portion with the base plate 11 is as firm as possible. This can be achieved, for instance, in that the cover 14 is provided with an inner annular recess 38, for engagement by a peripheral annular flange 39 provided on the base plate 11. In this case, the cover 14 cannot move relative to the base plate 11 so that the relations diaphragm/contact disc 18/contact pin 25, which essentially define the adjustment, remain unaffected when the switch is pressed into the board.

As a supplementary feature, the electric contact of the connection contacts projecting outwardly from the switch is established simultaneously when mechanically mounting the switch by means of the latching device just described. According to an essential feature of the present invention, this effect is achieved in that these connection contacts are provided with springs 40 which have at least their lower windings in firm and conductive contact with the electrically conductive areas of the projecting contact pins 21, 25 and which extend upwardly up to a height—indicated in FIG. 1 by the additional windings 40′ shown in broken lines—in which the upper windings of the said springs 40, which establish the electric contact, rest against preferably annular conductor path areas 41 provided or laminated on the bottom face of the print board 31 when the switch is locked in position by means of the at least one latching element 32*a*. . .(see FIG. 2). It goes without saying that a great number of modifications can be envisaged in this connection. For instance, the diameter of the contact pins may slightly increase from the top to the bottom so that the hold of the springs gets firmer as they are pressed down; or the contact pins may extend with their upper portions into matching openings provided in the circuit board 31, or end at a certain distance below the printed circuit board or print board 31. The spacing between the supporting board 31 and the base plate 11 of the housing of the pressure-sensitive switch, which is determined by the latching means 35, 36 of the latching elements 32*a*, 32*b* . . . is not critical, for the contact springs 40 carried on the contact pins may, depending on their size, bridge any desired spacing and still bear firmly against the annular area 41 of the circuit board to establish safely the electric contact. It is also possible to have the lower windings of the contact springs 40 rest against the shoulder 23 of the surrounding plastic cylinder 22, 29 and to have the contact pins project through the full thickness or through part of the supporting board. Further, it may be advantageous to provide a possibility of adjustment for at least the central contact pin 25 which is the one on which the adjustment is effected. This possibility may consist of a central bore 42 provided in the supporting board 31 so that the user is placed in a position even to re-adjust the switch if desired.

All the features described and shown in the specification, the following claims and the drawing may be essential to the invention either individually or in any desired combinations.

I claim:

1. A pressure-sensitive switch comprising a housing having a pressure chamber therein, said housing being provided with a base, a diaphragm within said pressure chamber normally in a home position and movable therefrom in response to pressure changes within said chamber, biasing means for biasing said diaphragm to said home position, at least one electrical contact projecting outwardly from said housing base and adapted to be connected to a circuit board, at least one latching element positioned inwardly from the edge of said base and extending outwardly from said housing for mounting said housing on the circuit board, said latching element comprising a depending leg having engaging means at the end thereof for engaging a portion of the circuit board to mount said housing thereon in spaced relation to the board, and electrical connecting means for connecting said contact to the circuit board.

2. a pressure-sensitive switch as in claim 1, in which said electrical connecting means comprises an electrical conductive spring electrically connected to said contact and adapted to engage an electric conductor on the circuit board.

3. A pressure-sensitive switch as in claim 1, and at least three latching elements formed integrally with said base to connect said housing with the circuit board, each of said latching elements being spaced inwardly from the edge of said base and each having a board engaging means at the end thereof for engaging a portion of the circuit board to mount said housing thereon in spaced relation to the board.

4. A pressure-sensitive switch as in claim 1, in which said electrical connecting means comprising a contact spring in the form of an electrically conductive spiral spring superimposed upon said electrical contact, said spring being of sufficient length to extend between said electrical contact and a conductor path on a circuit board when said latching element is in operative position on the circuit board.

5. A pressure-sensitive switch as in claim 1, in which said diaphragm is in the shape of a cup, said housing having a sidewall, and said base having an annular flange, said diaphragm being received between said sidewall and said annular flange in sealing engagement therewith.

6. A pressure-sensitive switch as in claim 5, in which said sidewall is provided with an annular groove adjacent the lower end thereof, said base being received in said annular groove.

7. A pressure-sensitive switch as in claim 1, and a contact plate movable by said diaphragm, said biasing means comprising an electrically conductive spring engaging said base at one end and said contact plate at the other end to bias said contact plate against said diaphragm to maintain said diaphragm in said home position, a first contact pin threadedly engaged in said base and extending outwardly therefrom, whereby rotation of said first contact pin causes axial movement of said contact pin so that said pin may be positioned a preselected distance from said contact plate, and a second electrically conductive pin connected to said spring.

8. A pressure-sensitive swich and a circuit board combination comprising a housing having a pressure chamber therein, said housing being provided with a base, a diaphragm within said pressure chamber normally in a home position and movable therefrom in response to pressure changes within said chamber, biasing means for biasing said diaphragm to said home position, at least one electrical contact projecting outwardly from said housing base and connected to said circuit board, at least one latching element positioned inwardly from the edge of said base and extending outwardly from said housing and mounting said housing on the circuit board, said latching element comprising a depending leg having engaging means at the end thereof engaging a portion of the circuit board and mounting said housing thereon in spaced relation to the board, and electrical connecting means connecting said contact to the circuit board.

9. The combination of claim 8, in which said circuit board having an opening therein through which said depending leg extends, said engaging means comprising a slot at the end of said leg for receiving therein the edge of the circuit board defining said circuit board opening.

10. The combination of claim 9, in which said base comprises a depending bushing fabricated from an insulating material, a threaded electrically conducting sleeve within said bushing, and an electrical contact threadedly engaged in said bushing and axially movable with respect to said pressure chamber, said sleeve extending beyond said bushing, a conductive path on said circuit board, said electrical connecting means connecting said sleeve with said path to provide an electrical connection therebetween, and an opening in said circuit board overlying said contact pin to permit rotation of said pin within said sleeve.

* * * * *